US006142704A

United States Patent [19]

Coyne

[11] Patent Number: 6,142,704

[45] Date of Patent: Nov. 7, 2000

[54] WAVE BARRIER

[76] Inventor: Jon Coyne, 80-24 Sweet Briar Dr., Clark, N.J. 07066

[21] Appl. No.: 09/186,256

[22] Filed: Nov. 5, 1998

[51] Int. Cl.[7] ..... E01F 7/00

[52] U.S. Cl. ..... 405/114; 405/21; 405/115; 256/13; 256/24; 256/31; 256/45

[58] Field of Search ..... 405/15, 21, 52, 405/107, 114, 115, 91; 256/1, 13, 23, 24, 31, 45, 73

[56] References Cited

U.S. PATENT DOCUMENTS

| | | | |
|---|---|---|---|
| 898,984 | 9/1908 | McFarlane | 405/91 |
| 2,698,518 | 1/1955 | Hofferber | 405/91 |
| 3,218,810 | 11/1965 | Grether et al. | 405/107 |
| 4,136,995 | 1/1979 | Fish | 405/115 |
| 4,310,262 | 1/1982 | Calza et al. | 405/87 |
| 4,321,774 | 3/1982 | Fish | 405/115 X |
| 4,366,949 | 1/1983 | Staub, Sr. | 256/1 |
| 4,818,141 | 4/1989 | Rauch | 405/21 X |
| 4,921,373 | 5/1990 | Coffey | 405/115 |
| 5,470,177 | 11/1995 | Hughes | 405/115 |
| 5,810,334 | 9/1998 | Mensaker | 256/1 X |
| 5,899,632 | 5/1999 | Martin | 405/21 X |

*Primary Examiner*—Eileen D. Lillis
*Assistant Examiner*—Tara L. Mayo

[57] ABSTRACT

A wave barrier for protecting users and their possessions at a beach location close to the water from becoming wet from waves crashing into their location. The wave barrier includes a flexible wall sheet with a plurality of spaced apart elongate poles coupled thereto. The lower ends of the poles are downwardly extended from a bottom edge of the wall sheet. The proximal edge of a ground sheet is coupled to the wall sheet along the bottom edge of the wall sheet.

14 Claims, 2 Drawing Sheets

WAVE BARRIER

BACKGROUND OF THE INVENTION

1. Field of the Invention

The present invention relates to wave barriers and more particularly pertains to a new wave barrier for protecting users and their possessions at a beach location close to the water from becoming wet from waves crashing into their location.

2. Description of the Prior Art

The use of wave barriers is known in the prior art. More specifically, wave barriers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,818,141; U.S. Pat. No. 3,085,404; U.S. Pat. No. 4,790,685; U.S. Pat. No. 2,364,072; U.S. Pat. No. Des. 348,937; and U.S. Pat. No. 1,816,095.

While these devices fulfill their respective, particular objectives and requirements, the aforementioned patents do not disclose a new wave barrier. The inventive device includes a flexible wall sheet with a plurality of spaced apart elongate poles coupled thereto. The lower ends of the poles are downwardly extended from a bottom edge of the wall sheet. The proximal edge of a ground sheet is coupled to the wall sheet along the bottom edge of the wall sheet.

In these respects, the wave barrier according to the present invention substantially departs from the conventional concepts and designs of the prior art, and in so doing provides an apparatus primarily developed for the purpose of protecting users and their possessions at a beach location close to the water from becoming wet from waves crashing into their location.

SUMMARY OF THE INVENTION

In view of the foregoing disadvantages inherent in the known types of wave barriers now present in the prior art, the present invention provides a new wave barrier construction wherein the same can be utilized for protecting users and their possessions at a beach location close to the water from becoming wet from waves crashing into their location.

The general purpose of the present invention, which will be described subsequently in greater detail, is to provide a new wave barrier apparatus and method which has many of the advantages of the wave barriers mentioned heretofore and many novel features that result in a new wave barrier which is not anticipated, rendered obvious, suggested, or even implied by any of the prior art wave barriers, either alone or in any combination thereof.

To attain this, the present invention generally comprises a flexible wall sheet with a plurality of spaced apart elongate poles coupled thereto. The lower ends of the poles are downwardly extended from a bottom edge of the wall sheet. The proximal edge of a ground sheet is coupled to the wall sheet along the bottom edge of the wall sheet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wave barrier apparatus and method which has many of the advantages of the wave barriers mentioned heretofore and many novel features that result in a new wave barrier which is not anticipated, rendered obvious, suggested, or even implied by any of the prior art wave barriers, either alone or in any combination thereof.

It is another object of the present invention to provide a new wave barrier which may be easily and efficiently manufactured and marketed.

It is a further object of the present invention to provide a new wave barrier which is of a durable and reliable construction.

An even further object of the present invention is to provide a new wave barrier which is susceptible of a low cost of manufacture with regard to both materials and labor, and which accordingly is then susceptible of low prices of sale to the consuming public, thereby making such wave barrier economically available to the buying public.

Still yet another object of the present invention is to provide a new wave barrier which provides in the apparatuses and methods of the prior art some of the advantages thereof, while simultaneously overcoming some of the disadvantages normally associated therewith.

Still another object of the present invention is to provide a new wave barrier for protecting users and their possessions at a beach location close to the water from becoming wet from waves crashing into their location.

Yet another object of the present invention is to provide a new wave barrier which includes a flexible wall sheet with a plurality of spaced apart elongate poles coupled thereto. The lower ends of the poles are downwardly extended from a bottom edge of the wall sheet. The proximal edge of a ground sheet is coupled to the wall sheet along the bottom edge of the wall sheet.

Still yet another object of the present invention is to provide a new wave barrier that that may be collapsed and folded or rolled into a compact configuration for convenient transport and storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
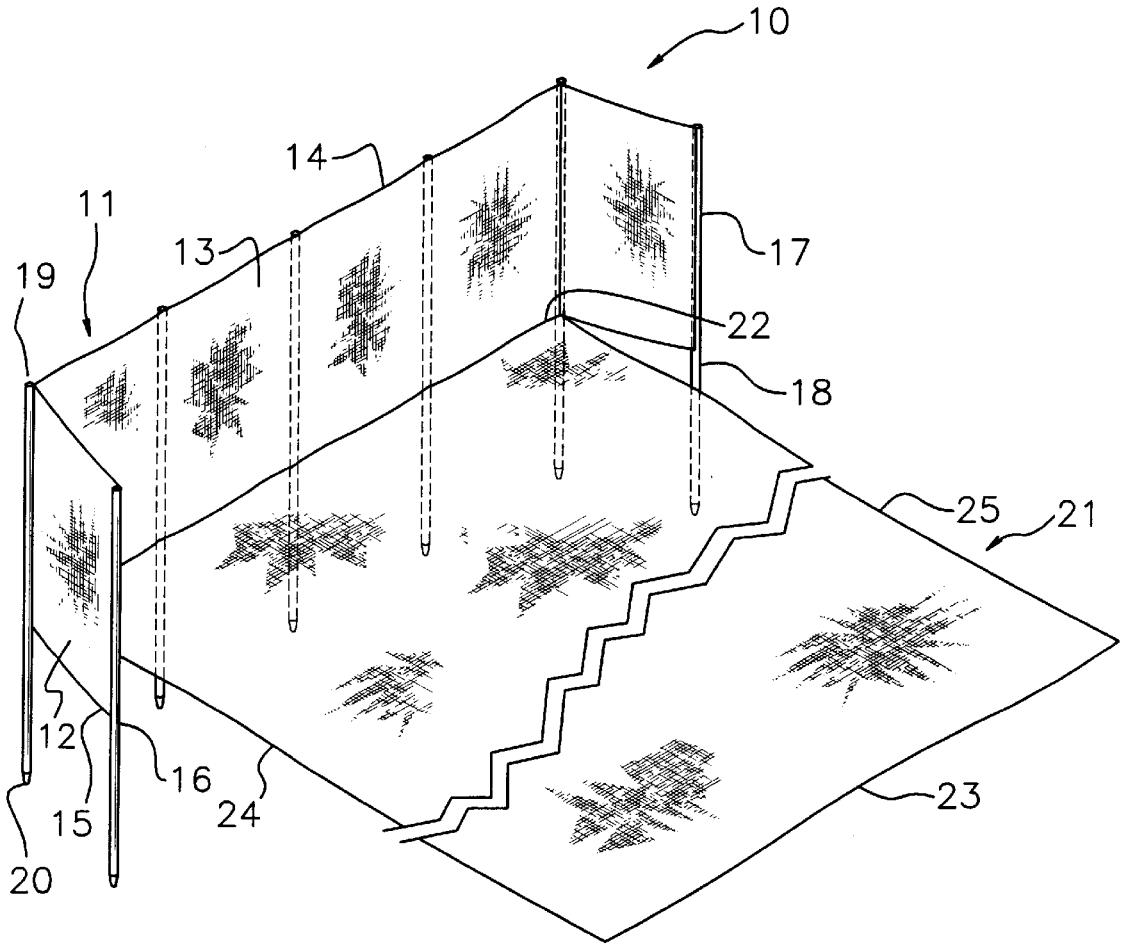
FIG. 1 is a schematic perspective view of a new wave barrier according to the present invention.
Figure 2:
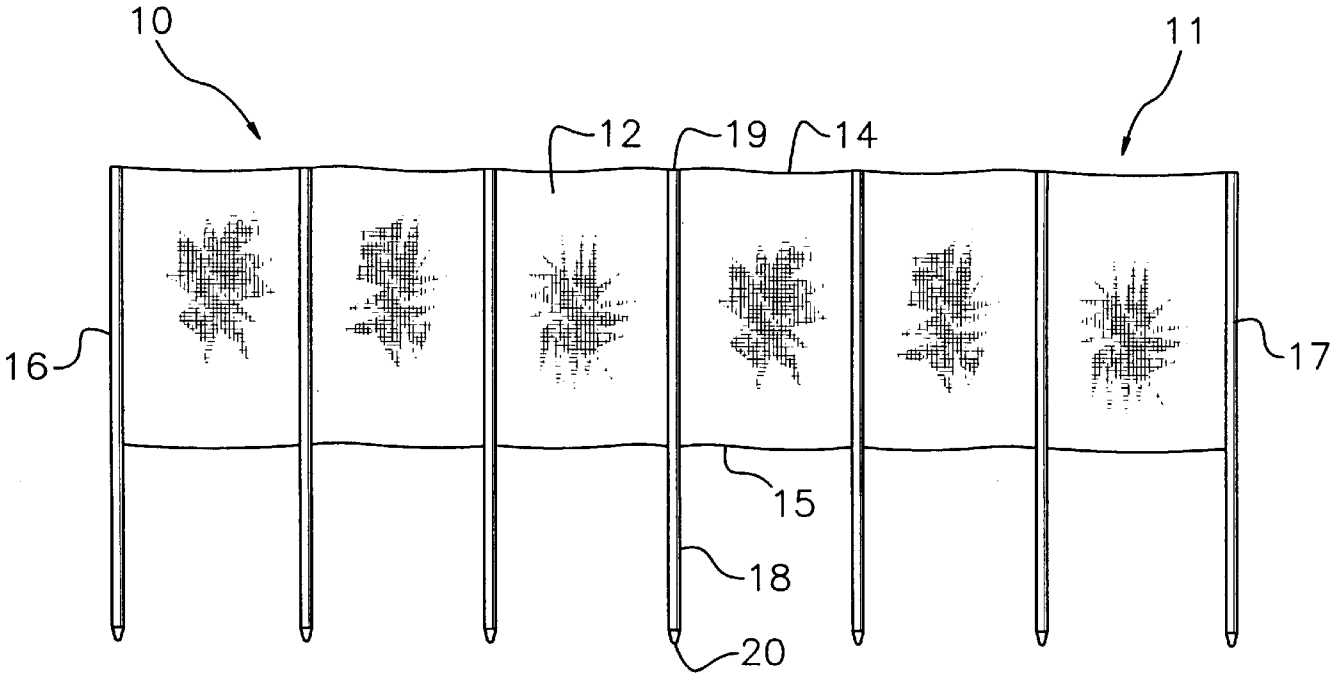
FIG. 2 is a schematic side view of the present invention.
Figure 3:
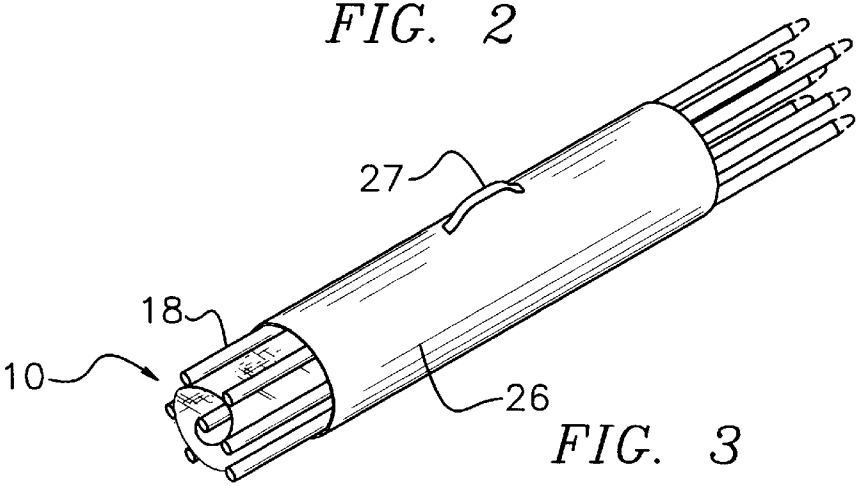
FIG. 3 is a schematic perspective view of the present invention rolled up in the carrying sleeve.

With reference now to the drawings, and in particular to FIGS. 1 through 3 thereof, a new wave barrier embodying the principles and concepts of the present invention and generally designated by the reference numeral 10 will be described.

As best illustrated in FIGS. 1 through 3, the wave barrier 10 generally comprises a flexible wall sheet with a plurality of spaced apart elongate poles coupled thereto. The lower ends of the poles are downwardly extended from a bottom edge of the wall sheet. The proximal edge of a ground sheet is coupled to the wall sheet along the bottom edge of the wall sheet.

In use, the wave barrier 10 is designed for protecting users and their possessions at a beach location near the water from becoming wet from waves crashing into their beach location as the tide rises. Specifically, the wave barrier 10 comprises a generally rectangular flexible wall sheet 11 having generally rectangular first and second faces 12,13, generally straight top and bottom edges 14,15, and a pair of generally straight end edges 16,17 extending between the top and bottom edges of the wall sheet. The top and bottom edges of the wall sheet are preferably extended substantially parallel to one another. The end edges of the wall sheet are preferably extended substantially parallel to one another and substantially perpendicular to the top and bottom edges of the wall sheet.

The wall sheet preferably comprises a substantially water proof material to resist the passage of water through the wall sheet between the first and second faces of the wall sheet. Ideally, the wall sheet comprises a water proof flexible plastic material. The wall sheet has a height defined between the top and bottom edges of the wall sheet and a width defined between the end edges of the wall sheet. Preferably, the width of the wall sheet is greater than the height of the wall sheet. Even more preferably, the width of the wall sheet is about four times greater than the height of the wall sheet. In an ideal illustrative embodiment, the height of wall sheet is about 18 inches to provide sufficient protection from encroaching waves while not hindering a user's view of the waterfront above the wall sheet when sitting next to the wall sheet. In this ideal illustrative embodiment, the width of the wall sheet is about 6 feet to provide coverage of sufficient area for a user to occupy at a beach.

A plurality of spaced apart elongate poles 18 are coupled to the first face of the wall sheet. The poles each have upper and lower ends 19,20 and a longitudinal axis extending between the upper and lower ends of the respective pole. Ideally, the plurality of poles comprises seven poles to provide optimal support to the wall structure with a width of about 6 feet. The poles are arranged in a row extending between the end edges of the wall sheet. Preferably, the poles are spaced apart at about equal intervals along the row. In a preferred embodiment, the interval between the poles is greater than about one-third the width of the wall sheet. Ideally, the interval between the poles is about one-sixth the width of the wall sheet. In the ideal illustrative embodiment, the interval between the poles is about 1 foot.

The longitudinal axes of the poles are preferably extended substantially parallel to one another with the longitudinal axes of the poles also being extended substantially parallel to the end edges of the wall sheet and substantially perpendicular to the top and bottom edges of the wall sheet. Preferably, a first of the poles is positioned along a first of the end edges of the wall sheet and a second of the poles is positioned along a second of the end edges of the sheet.

The upper ends of the poles are positioned adjacent the top edge of the sheet such that the upper ends of the poles and the top edge of the sheet generally lie in a common plane. The lower ends of the poles are downwardly extended from the bottom edge of the wall sheet. In use, the lower ends of the poles are designed for inserting into a ground surface such as the sandy ground surface of a beach such that the wall sheet is extended generally vertically upwards from the ground surface with the first face of the wall sheet facing the water front. Preferably, the lower ends of the poles each taper to a blunt tip to aid insertion of the lower ends of the poles into the ground surface.

The lower ends of the poles each are spaced apart from the bottom edge of the sheet a distance less than the height of the wall sheet. Preferably, the height of the wall sheet is greater than the distance between the lower end of each pole and the bottom edge of the wall sheet. Even more preferably, the distance between the lower end of each pole and is about two-thirds the height of the wall sheet. In the ideal illustrative embodiment, the distance between the lower end of each pole and the bottom ledge is about 12 inches.

A generally rectangular flexible ground sheet 21 is provided having generally straight proximal and distal edges 22,23 and a pair of generally straight side edges 24,25 extending between the proximal and distal edges of the ground sheet. The proximal and distal edges of the ground sheet are preferably extended substantially parallel to one another. The side edges of the ground sheet are preferably extended substantially parallel to one another and substantially perpendicular to the proximal and distal edges of the ground sheet. The proximal edge of the ground sheet is coupled to the second face of the wall sheet along the bottom edge of the wall sheet. In use, the ground sheet is designed for laying on the ground surface so that the wall sheet is positioned between the ground sheet and the water front. In use, the ground sheet may sat on sitting on by users and resting their possessions thereon to protect them from becoming wet from water from waves that pass beneath the wall sheet.

Like the wall sheet, the ground sheet comprises a substantially water proof material to resist the passage of water through the ground sheet. Ideally, the ground sheet comprises a water proof flexible plastic material. The ground sheet has a length defined between the proximal and distal edges of the ground sheet and a width defined between the side edges of the sheet. Preferably, the length and width of the ground sheet are about equal to one another. The width of the sheet is equal to or less than the width of the wall sheet.

The poles divide the wall sheet into plurality of rectangular panels. In one preferred embodiment, the width of the ground sheet extends between the poles adjacent to the first and second poles at the end edges of the wall sheet. As illustrated in FIG. 1, in use, this permits the panels closest to the end edges of the wall sheet to be folded towards the side edges of the ground sheet to protect the ground sheet from waves lapping around the ends of the wall sheet.

In use, the ground sheet may be folded or rolled up next to the wall sheet so that the wall sheet, ground sheet and poles may be rolled up into a compact roll for convenient transport and storage. With reference to FIG. 3, ideally, a cylindrical carrying sleeve 26 with a pair of open ends and a carrying handle 27 may be provided for inserting the wave barrier therein to keep the wave barrier in its compacted roll form and to permit a user to easily carry the wave barrier As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wave barrier, comprising:

a flexible wall sheet having first and second faces, top and bottom edges, and a pair of end edges extending between said top and bottom edges of said wall sheet;

a plurality of spaced apart elongate poles being coupled to said first face of said wall sheet, said poles each having upper and lower ends and a longitudinal axis extending between said upper and lower ends of the respective pole;

said lower ends of said poles being outwardly extended from said bottom edge of said wall sheet;

a flexible ground sheet having proximal and distal edges and a pair of side edges extending between said proximal and distal edges of said ground sheet;

said proximal edge of said ground sheet being coupled to said second face of said wall sheet along said bottom edge of said wall sheets;

wherein a first of said poles is positioned along a first of said end edges of said wall sheet, and a second of said poles is positioned along a second of said end edges of said sheet, wherein a first adjacent pole is positioned adjacent to said first pole and a second adjacent pole is positioned adjacent to said second pole; and wherein said poles divide said wall sheet into a plurality of rectangular panels, wherein a width of said ground sheet extends between said first adjacent pole and said second adjacent pole such that said panels located closest to said end edges of said wall sheet are foldable inward towards said side edges of said ground sheet for protecting said ground sheet from waves lapping around said end edges of said wall sheet.

2. The wave barrier of claim 1, wherein said top and bottom edges of said wall sheet are extended substantially parallel to one another, said end edges of said wall sheet are extended substantially parallel to one another and substantially perpendicular to said top and bottom edges of said wall sheet.

3. The wave barrier of claim 1, wherein said wall sheet comprises a substantially water proof material to resist the passage of water through said wall sheet between said first and second faces of said wall sheet, and wherein said ground sheet comprises a substantially water proof material to resist the passage of water through said ground sheet.

4. The wave barrier of claim 1, wherein said wall sheet has a height defined between said top and bottom edges of said wall sheet and a width defined between said end edges of said wall sheet, and wherein said width of said wall sheet is greater than said height of said wall sheet.

5. The wave barrier of claim 4, wherein said width of said wall sheet is about four times greater than said height of said wall sheet.

6. The wave barrier of claim 1, wherein said poles are arranged in a row extending between said end edges of said wall sheet, wherein said poles are spaced apart at about equal intervals along said row.

7. The wave barrier of claim 6, wherein said wall sheet has a width defined between said end edges of said wall sheet, and wherein said interval between said poles is greater than about one-third said width of said wall sheet.

8. The wave barrier of claim 1, wherein said longitudinal axes of said poles are extended substantially parallel to one another, wherein said longitudinal axes of said poles are extended substantially parallel to said end edges of said wall sheet and substantially perpendicular to said top and bottom edges of said wall sheet.

9. The wave barrier of claim 1, wherein said upper ends of said poles are positioned adjacent said top edge of said sheet.

10. The wave barrier of claim 1, wherein said lower ends of said poles each taper to a tip.

11. The wave barrier of claim 1, wherein said lower ends of said poles each is spaced apart from said bottom edge of said sheet a distance less than a height of said wall sheet defined between said to and bottom edges of said sheet.

12. The wave barrier of claim 11, wherein said height of said wall sheet is greater than said distance between said lower end of each pole and said bottom edge of said wall sheet.

13. The wave barrier of claim 11, wherein said distance between said lower end of each pole and said bottom edge of said wall sheet is about two-thirds said height of said wall sheet.

14. A wave barrier, comprising:

a generally rectangular flexible wall sheet having generally rectangular first and second faces, generally straight top and bottom edges, and a pair of generally straight end edges extending between said top and bottom edges of said wall sheet;

said top and bottom edges of said wall sheet being extended substantially parallel to one another, said end edges of said wall sheet being extended substantially parallel to one another and substantially perpendicular to said top and bottom edges of said wall sheet;

said wall sheet comprising a substantially water proof material to resist the passage of water through said wall sheet between said first and second faces of said wall sheet;

wherein said wall sheet comprises a water proof flexible plastic material;

said wall sheet having a height defined between said top and bottom edges of said wall sheet and a width defined between said end edges of said wall sheet;

wherein said width of said wall sheet is about four times greater than said height of said wall sheet;

wherein said height of wall sheet is about 18 inches to provide protection from encroaching waves while not hindering a user's view of the waterfront above said wall sheet when sitting next said wall sheet;

wherein said width of said wall sheet is about 6 feet to provide coverage of an area for the user to occupy at a beach;

a plurality of spaced apart elongate poles being coupled to said first face of said wall sheet, said poles each having upper and lower ends and a longitudinal axis extending between said upper and lower ends of the respective pole;

wherein said plurality of poles comprises seven poles to provide optimal support to said wall sheet with a width of about 6 feet;

said poles being arranged in a row extending between said end edges of said wall sheet, said poles being spaced apart at about equal intervals along said row;

wherein each of said intervals between said poles is about one-sixth said width of said wall sheet;

wherein each of said intervals between said poles is about 1 foot;

said longitudinal axes of said poles being extended substantially parallel to one another, said longitudinal axes of said poles being extended substantially parallel to said end edges of said wall sheet and substantially perpendicular to said top and bottom edges of said wall sheet;

a first of said poles being positioned along a first of said end edges of said wall sheet, a second of said poles being positioned along a second of said end edges of said sheet, wherein a first adjacent pole is positioned adjacent to said first pole and a second adjacent pole is positioned adjacent to said second pole;

said upper ends of said poles being positioned adjacent said top edge of said sheet such that said upper ends of said poles and said top edge of said sheet generally lie in a common plane;

said lower ends of said poles being outwardly extended from said bottom edge of said wall sheet;

said lower ends of said poles being adapted for inserting into a ground surface such that said wall sheet is extended generally vertically upwards from the ground surface with said first face of said wall sheet facing the waterfront;

said lower ends of said poles each tapering to a tip;

said lower ends of said poles each being spaced apart from said bottom edge of said sheet a distance less than said height of said wall sheet;

wherein said distance between said lower end of each pole and said bottom edge of said wall sheet is about two-thirds said height of said wall sheet;

wherein said distance between said lower end of each pole and said bottom edge is about 12 inches;

a generally rectangular flexible ground sheet having generally straight proximal and distal edges and a pair of generally straight side edges extending between said proximal and distal edges of said ground sheet;

said proximal and distal edges of said ground sheet being extended substantially parallel to one another, said side edges of said ground sheet being extended substantially parallel to one another and substantially perpendicular to said proximal and distal edges of said ground sheet;

said proximal edge of said ground sheet being coupled to said second face of said wall sheet along said bottom edge of said wall sheet;

said ground sheet being adapted for laying on the ground surface such that said wall sheet is positioned between said ground sheet and the waterfront, said ground sheet being adapted for sitting on by users and their possession thereon for protecting them from becoming wet from waves of water that pass beneath said wall sheet;

said ground sheet comprising a substantially water proof material to resist the passage of water through said ground sheet;

wherein said ground sheet comprises a water proof flexible plastic material;

said ground sheet having a length defined between said proximal and distal edges of said ground sheet and a width defined between said side edges of said sheet;

wherein said length and width of said ground sheet are about equal to one another;

wherein said width of said sheet is less than said width of said wall sheet;

wherein said poles divide said wall sheet into a plurality of rectangular panels, wherein a width of said ground sheet extends between said first adjacent pole and second adjacent pole such that said panels located closest to said end edges of said wall sheet are foldable inward towards said side edges of said ground sheet for protecting said ground sheet from waves lapping around said end edges of said wall sheet;

wherein said ground sheet may be folded or rolled up next to said wall sheet so that said wall sheet, ground sheet and poles may be rolled up into a compact roll for convenient transport and storage;

wherein a cylindrical carrying sleeve having a pair of open ends and a carrying handle may be provided for inserting said rolled up wall sheet, ground sheet and poles therein to keep the said wall sheet, ground sheet and poles in its compacted roll form and to permit a user to carry said wall sheet, ground sheet and poles.

* * * * *